US009562691B2

(12) United States Patent
Ford et al.

(10) Patent No.: US 9,562,691 B2
(45) Date of Patent: Feb. 7, 2017

(54) AIRBLAST FUEL INJECTOR

(71) Applicant: ROLLS-ROYCE PLC, London (GB)

(72) Inventors: Christopher Ford, Dulverton (GB); Ashley Gavin Barker, Loughborough (GB); Alastair Duncan Walker, Loughborough (GB); Jonathan Carrotte, Leicester (GB)

(73) Assignee: ROLLS-ROYCE plc, London (GB)

( * ) Notice: Subject to any disclaimer, the term of this patent is extended or adjusted under 35 U.S.C. 154(b) by 256 days.

(21) Appl. No.: 14/490,789

(22) Filed: Sep. 19, 2014

(65) Prior Publication Data

US 2015/0089920 A1 Apr. 2, 2015

(30) Foreign Application Priority Data

Sep. 30, 2013 (GB) ..... 1317241.6

(51) Int. Cl.
*F23R 3/30* (2006.01)
*F23R 3/14* (2006.01)

(52) U.S. Cl.
CPC .. *F23R 3/30* (2013.01); *F23R 3/14* (2013.01)

(58) Field of Classification Search
CPC ..... F23R 3/14; F23R 3/30
See application file for complete search history.

(56) References Cited

U.S. PATENT DOCUMENTS 5,431,019 A 7/1995 Myers et al.
6,141,967 A 11/2000 Angel et al.
6,418,726 B1 7/2002 Foust et al.
6,968,692 B2 11/2005 Chin et al.
7,217,101 B2 * 5/2007 Harvey ..... F01D 5/141 416/223 A
2005/0028525 A1 2/2005 Toon et al.
2006/0248898 A1 11/2006 Buelow et al.
2007/0289306 A1 12/2007 Suria et al.
2008/0148736 A1 6/2008 Ishizaka et al.
(Continued)

FOREIGN PATENT DOCUMENTS

DE 2026883 12/1971
EP 1 719 950 A2 11/2006
(Continued)

OTHER PUBLICATIONS

Search Report issued in British Patent Application No. 1317241.6 dated Mar. 18, 2014.

(Continued)

*Primary Examiner* — Carlos A Rivera
(74) *Attorney, Agent, or Firm* — Oliff PLC

(57) ABSTRACT

An airblast fuel injector is provided for a fuel spray nozzle of a gas turbine engine. The injector has an annular air passage for the passage of a swirling air flow therethrough. The swirling air flow is used by the injector to produce an atomized fuel spray. The air passage contains a swirler for producing the swirling air flow, the swirler comprising a circumferential row of vanes which span inner and outer side walls of the air passage. Viewed on a longitudinal section through the injector, the air passage has a bend downstream of the swirler, the bend changing the direction of the air passage. The vanes are configured to introduce a radial component to the air flow exiting the swirler, the radial component guiding the air flow around the bend.

12 Claims, 6 Drawing Sheets

(56) References Cited

U.S. PATENT DOCUMENTS

| | | | | |
|---|---|---|---|---|
| 2010/0308135 | A1 | 12/2010 | Yamamoto et al. | |
| 2010/0326079 | A1* | 12/2010 | Zuo | F23R 3/286 60/748 |
| 2011/0005232 | A1 | 1/2011 | Williams et al. | |
| 2011/0271680 | A1 | 11/2011 | Bagchi et al. | |
| 2014/0245741 | A1* | 9/2014 | He | F01D 5/141 60/746 |

FOREIGN PATENT DOCUMENTS

| | | | |
|---|---|---|---|
| EP | 2 525 152 | A2 | 11/2012 |
| EP | 2 592 351 | A1 | 5/2013 |
| GB | 1 366 144 | | 9/1974 |
| GB | 2 276 715 | A | 10/1994 |

OTHER PUBLICATIONS

Jan. 21, 2015 Search Report Issued in European Application No. 14185282.

* cited by examiner

AIRBLAST FUEL INJECTOR

FIELD OF THE INVENTION

The present invention relates to an airblast fuel injector for combustors of gas turbine engines.

BACKGROUND TO THE INVENTION

Fuel injection systems deliver fuel to the combustion chamber of a gas turbine engine, where the fuel is mixed with air before combustion. One form of fuel injection system well-known in the art utilises fuel spray nozzles. These atomise the fuel to ensure its rapid evaporation and burning when mixed with air.

An airblast atomiser nozzle is a type of fuel spray nozzle in which fuel delivered to the combustion chamber by a fuel injector is aerated by air swirlers to ensure rapid mixing of fuel and air, and to create a finely atomised fuel spray. The swirlers impart a swirling motion to the air passing therethrough, so as to create a high level of shear and hence acceleration of the low velocity fuel film.

Typically, an airblast atomiser nozzle will have a number of coaxial air swirler passages. An annular fuel passage between a pair of swirler passages feeds fuel onto a prefilming lip, whereby a sheet of fuel develops on the lip. The sheet breaks down into ligaments which are then broken up into droplets within the shear layers of the surrounding highly swirling air to form the fuel spray stream that enters the combustor.

FIG. 1 shows schematically a longitudinal cross section through a conventional fuel spray nozzle 132 which injects a pilot flow of air and fuel and a mains flow of air and fuel into a combustor 130. The nozzle comprises a pilot airblast fuel injector having an annular fuel passage 134 which allows the fuel to flow as a film on an annular prefilmer surface. A pilot inner swirler 136 located on the centerline 135 of the nozzle and a pilot outer swirler 138, are used to swirl air past the film, causing the liquid fuel to be atomized into small droplets.

The fuel spray nozzle 312 further includes a mains airblast fuel injector which is coaxially located about the pilot airblast fuel injector. The mains airblast fuel injector has inner 142 and outer 144 main swirlers which are located coaxially inward and outward of a mains fuel passage 140.

All four swirlers 136, 138, 142 and 144 are fed from a common air supply system, and the relative volumes of air which flow through each of the swirlers are dependent upon the sizing and geometry of the swirlers and their associated air passages. Each swirler comprises a circumferential row of vanes. The two swirlers of each of the pilot and the mains fuel injectors may be either co-swirl or counter-swirl.

In the conventional fuel spray nozzle 132, the vanes of a given swirler extend generally radially, as depicted in FIG. 2, which shows schematically the trailing edges 146 of a row of vanes as viewed looking upstream along the respective air passage. In addition, to reduce slippage of air leaving the vane trailing edge, the vanes may be twisted so that the chordal lines of successive aerofoil sections are at increasing stagger angle with increasing radial height. An aim is to achieve a direction of flow leaving the vanes that is at a tangent to the pitch circle at all vane radial heights, as shown by the dashed arrowed lines in FIG. 2.

FIG. 3 shows an enlarged view of the mains inner swirler 142, its corresponding air passage 148, and an outlet port 150 of the mains fuel passage 140 of the fuel spray nozzle 132 of FIG. 1. The swirler is located in a cylindrical section of the air passage. In a following section, the air passage diverges (i.e. turns radially outwards). In the longitudinal cross sectional view of FIG. 3, the transition between the cylindrical and divergent sections appears as a bend 152 in the passage. The outlet port takes the form of an annular slot in the outer side wall of the air passage downstream of the bend. Fuel fed through the outlet port develops into a film on a frustoconical prefilmer surface 154 of the outer side wall. The swirling air flow (indicated by dotted arrowed lines) exiting the swirler travels along the air passage. In the divergent section, the flow area of the air passage may decrease, accelerating the air flow and helping it to atomize the liquid fuel film into small droplets.

The present invention is at least partly based on a recognition that, as a result of the bend 152, a thick boundary layer 156 can develop in the vicinity of the outlet port 150 and over the prefilmer surface 154. This boundary layer can reduce the effectiveness of the air flow in atomizing the fuel film. A related problem is that the bend itself can produce losses in the air flow, as it is forced by the bend to change direction.

SUMMARY OF THE INVENTION

Accordingly, a first aspect of the invention provides an airblast fuel injector for a fuel spray nozzle of a gas turbine engine, the fuel injector having an annular air passage for the passage of a swirling air flow therethrough, the swirling air flow being used by the fuel injector to produce an atomised fuel spray, wherein:

- the annular air passage contains a swirler for producing the swirling air flow, the swirler comprising a circumferential row of vanes which span inner and outer side walls of the annular air passage;
- viewed on a longitudinal section through the fuel injector, the annular air passage has a bend downstream of the swirler, the bend changing the direction of the annular air passage; and
- the vanes are configured to introduce a radial component to the air flow exiting the swirler, the radial component guiding the air flow around the bend.

Thus by appropriately configuring the vanes, the air flow can be turned radially by the swirler and guided around the bend, rather than relying solely on the bend itself to turn the air flow. In this way, losses in the air flow can be reduced, making the airflow a more efficient fuel atomizer A second aspect of the invention provides a fuel spray nozzle having an airblast fuel injector of the first aspect. For example, the airblast fuel injector may be a mains fuel injector, and the nozzle may further have a pilot fuel injector radially inwardly of the pilot fuel injector.

A third aspect of the invention provides a combustor of a gas turbine engine having a plurality of fuel spray nozzles of the second aspect.

A fourth aspect of the invention provides a gas turbine engine having a combustor of the third aspect.

Optional features of the invention will now be set out. These are applicable singly or in any combination with any aspect of the invention.

Typically the swirler is located in a cylindrical section of the annular air passage.

The bend can change the direction of the annular air passage such that the passage turns radially outwards downstream of the bend, the vanes being configured to introduce a radial outward component to the air flow exiting the swirler. For example, the air passage can be a mains inner air passage. Alternatively, the bend can change the direction of the annular air passage such that the passage turns radially inwards downstream of the bend, the vanes being configured to introduce a radial inward component to the air flow exiting the swirler. For example, the air passage can be a pilot or mains outer air passage.

The airblast fuel injector may further have an annular fuel passage coaxial with the annular air passage, the annular fuel passage feeding fuel into the annular air passage through a port (such as an annular slot) located downstream of the bend at the side wall of the annular air passage which, viewed on the longitudinal section through the fuel injector, forms the inside of the bend. The side wall may extend downstream from the port to form a fuel prefilmer surface. Advantageously, the radial component to the air flow introduced by the vanes can help to reduce flow separation and the thickness of the boundary layer formed in the vicinity of the port (and typically also over the prefilmer surface). In particular, the air velocity over the fuel film can be enhanced, to increase the shear forces between the air flow and the film, which in turn improves fuel atomization and mixing with the air flow before the flame-front.

The bend may be formed by smoothly curved portions of the side walls of the annular air passage. By smoothly curving the side walls, the sharp bend shown in FIG. 3 can be avoided, which, in combination with the radial component to the air flow introduced by the vanes, can further help to reduce flow separation and boundary layer thickness. For example, the smoothly curved portions may extend over at least 50% or 80% of the axial distance between the swirler and the fuel port (and preferably over the entire axial distance). The smoothly curved portions of the side walls may begin at the swirler.

Each vane is an aerofoil body having a leading edge, a trailing edge, a pressure surface and a suction surface. Cross sections through the vane at different radial positions provide respective aerofoil sections. A chordal line is the line connecting the leading and trailing edge on a given aerofoil section. Features of the geometry of the aerofoil body can be defined by the stacking of the aerofoil sections. In particular, the "lean" and the "sweep" of the aerofoil body can be defined with reference to the locus of a stacking axis which passes through a common point of each aerofoil section. The common point may be at the leading edge, trailing edge or the centroid of each aerofoil section.

As used herein, "lean" is the progressive displacement, with distance from a side wall, of the stacking axis in a circumferential direction of the injector.

As used herein, "sweep" is the progressive displacement, with distance from a side wall, of the stacking axis in the direction of air flow (ignoring swirl) through the passage. For a section of the passage having cylindrical side walls the direction of air flow is thus the axial direction of the injector. A leading edge is "forward swept" when the leading edge at the outer side wall is upstream of the leading edge at the inner side wall. In contrast, a leading edge is "rearward swept" when the leading edge at the outer side wall is downstream of the leading edge at the inner side wall.

According to one option, the vanes may be leant to introduce the radial component to the air flow exiting the swirler, such that, across each inter-vane passage formed by a suction surface of one vane and a facing pressure surface of a neighbouring vane, with increasing radial distance the lean inclines the suction surface towards the pressure surface. For example, both the leading and trailing edges of the vanes may be leant. Alternatively only one of the leading and trailing edges of the vanes may be leant (typically the trailing edge). This latter arrangement in particular can produce a highly twisted vane in which the chordal lines of the aerofoil sections are at different stagger angles. The lean may cause the or each leant stacking axis to incline by 10° or more from the radial direction. The lean can be constant across the radial span from the inner to the outer side wall, or may be variable e.g. with reduced lean towards the inner side wall.

Additionally or alternatively, according to another option, the leading and/or trailing edges of the vanes may be forward swept to introduce the radial component to the air flow exiting the swirler. For example, the angle of forward sweep of the leading and/or trailing edge may be 10° or more. That is, in a cylindrical section of the passage, the leading and/or trailing edge may incline at an angle of 10° or more from the radial direction.

BRIEF DESCRIPTION OF THE DRAWINGS

Embodiments of the invention will now be described by way of example with reference to the accompanying drawings in which.

DETAILED DESCRIPTION

Figure 4:
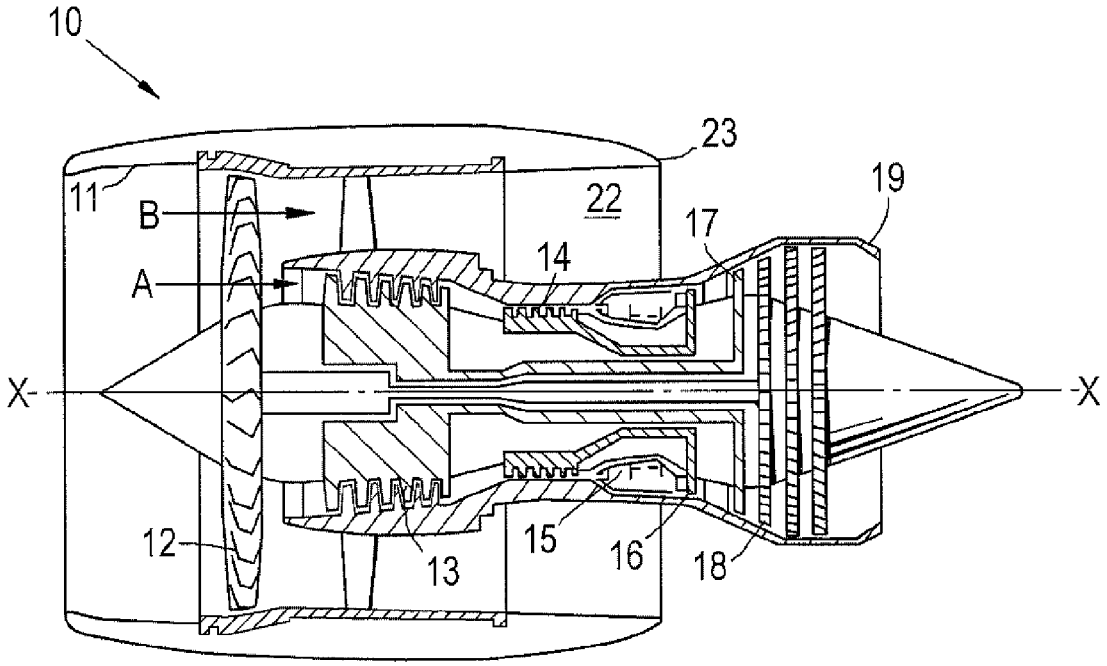
FIG. 4 shows schematically a longitudinal cross-section through a ducted fan gas turbine engine.

With reference to FIG. 4, a ducted fan gas turbine engine incorporating the invention is generally indicated at 10 and has a principal and rotational axis X-X. The engine comprises, in axial flow series, an air intake 11, a propulsive fan 12, an intermediate pressure compressor 13, a high-pressure compressor 14, combustion equipment 15, a high-pressure turbine 16, an intermediate pressure turbine 17, a low-pressure turbine 18 and a core engine exhaust nozzle 19. A nacelle 21 generally surrounds the engine 10 and defines the intake 11, a bypass duct 22 and a bypass exhaust nozzle 23.

During operation, air entering the intake 11 is accelerated by the fan 12 to produce two air flows: a first air flow A into the intermediate pressure compressor 13 and a second air flow B which passes through the bypass duct 22 to provide propulsive thrust. The intermediate pressure compressor 13 compresses the air flow A directed into it before delivering that air to the high pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines respectively drive the high and intermediate pressure compressors 14, 13 and the fan 12 by suitable interconnecting shafts.

Figure 1:
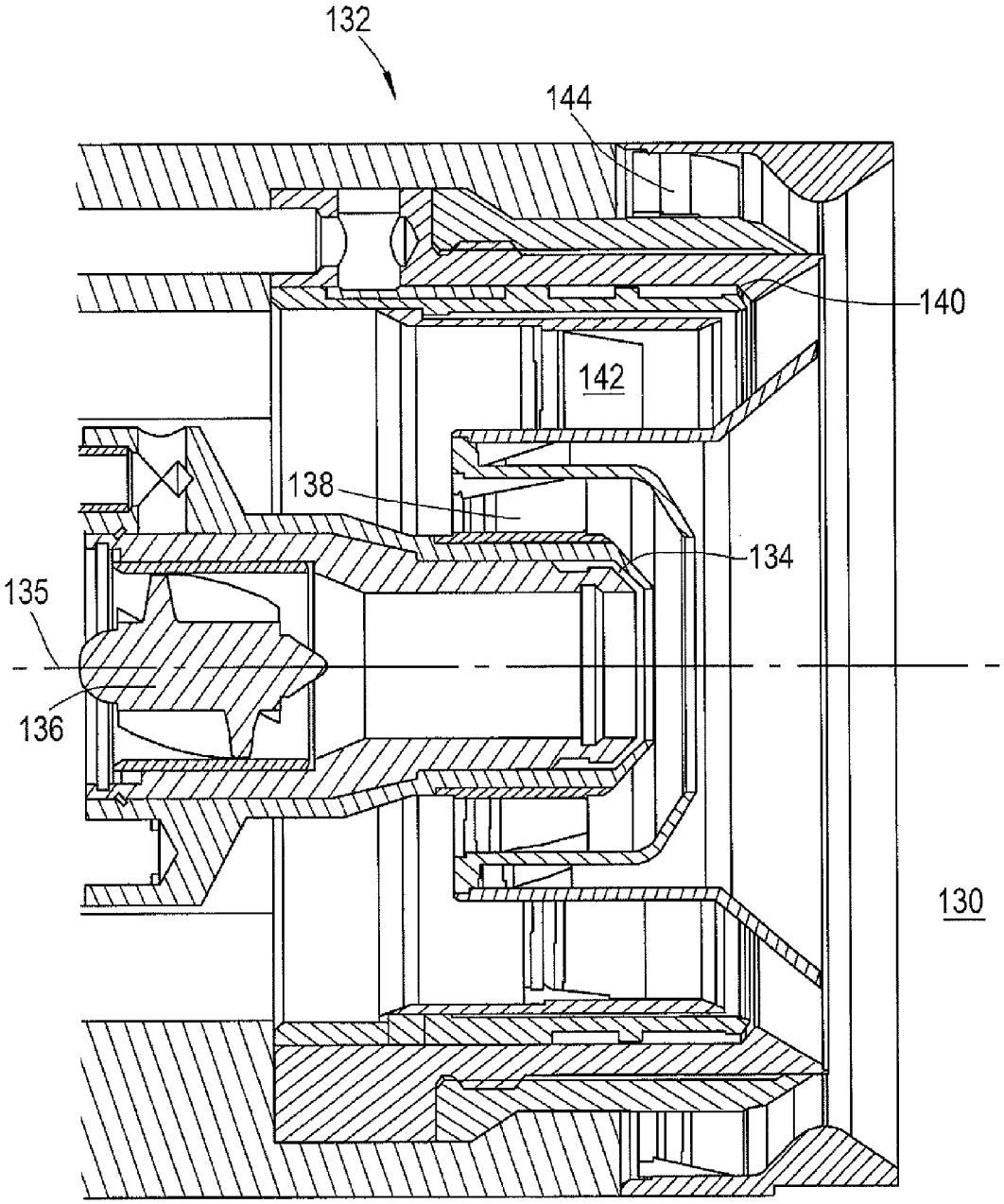
FIG. 1 shows schematically a longitudinal cross section through a conventional fuel spray nozzle.
Figure 2:
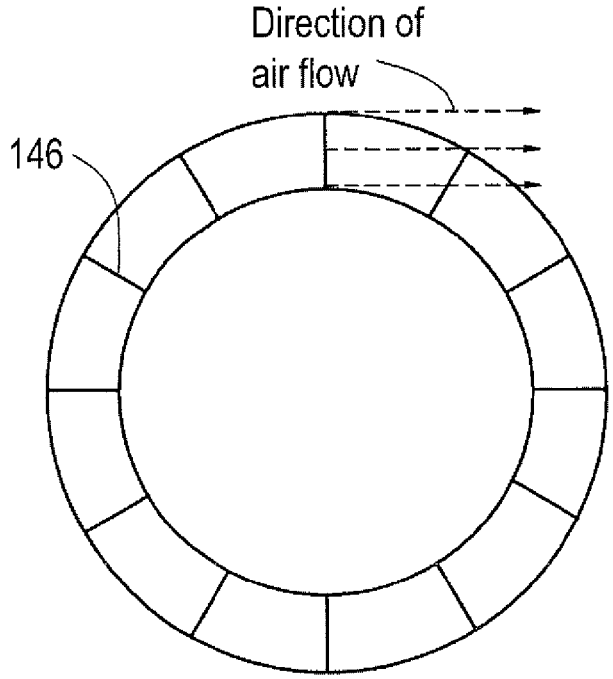
FIG. 2 shows schematically the trailing edges of a row of vanes of the conventional fuel spray as viewed looking upstream along their air passage.
Figure 3:
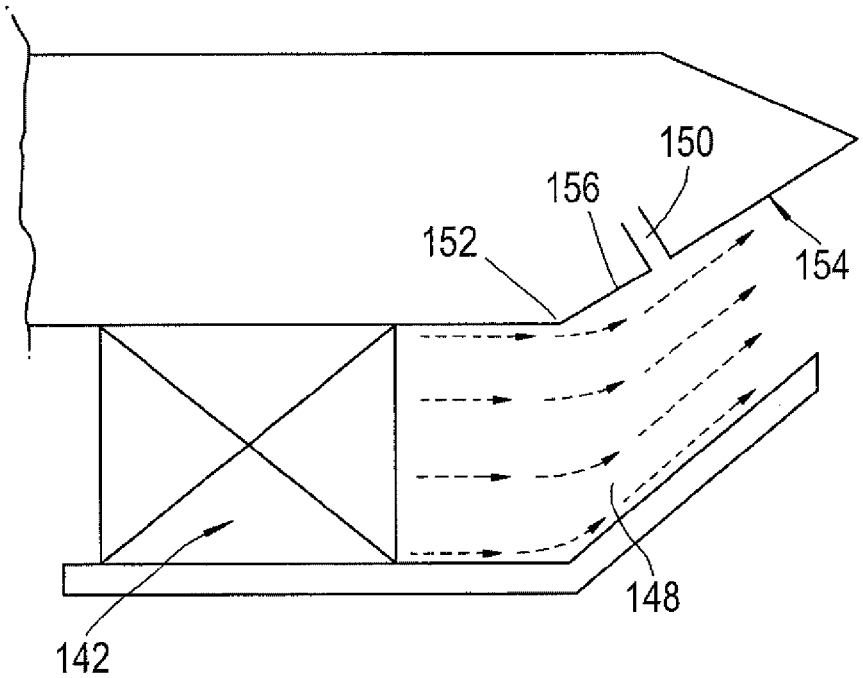
FIG. 3 shows an enlarged view of the mains inner swirler, its corresponding air passage, and an outlet port of the mains fuel passage of the fuel spray nozzle of FIG. 1.
Figure 5:
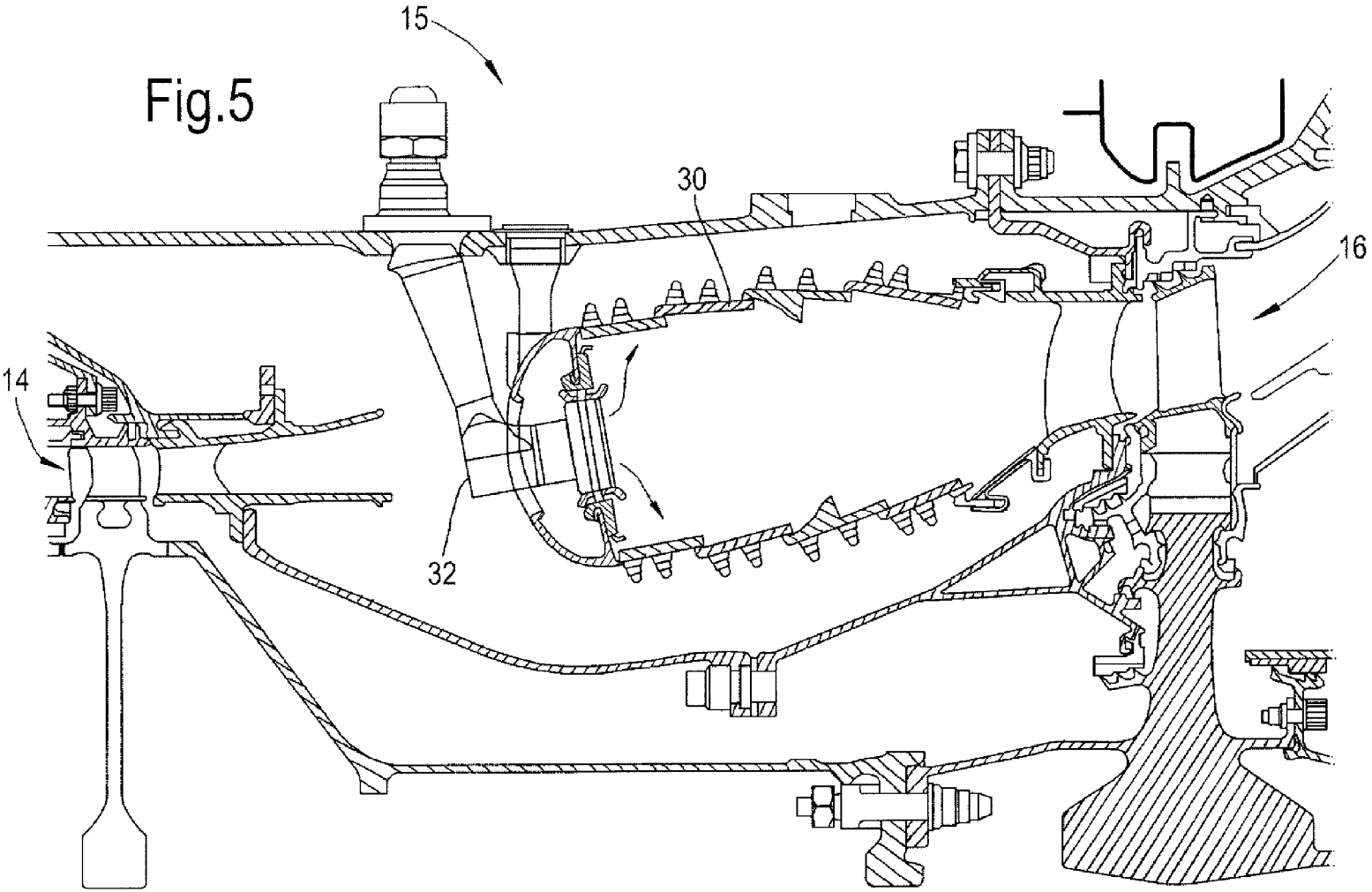
FIG. 5 shows schematically a longitudinal cross-section through combustion equipment of the gas turbine engine of FIG. 4.

FIG. 5 shows schematically a longitudinal cross-section through the combustion equipment 15 of the gas turbine engine 10 of FIG. 4. A row of fuel spray nozzles 32 spray the fuel into an annular combustor 30. Each fuel spray nozzle has the general configuration of the nozzle shown in FIG. 1, i.e. with a pilot airblast fuel injector and a mains airblast fuel injector which is coaxially located about the pilot airblast fuel injector. The pilot airblast fuel injector has an annular pilot fuel passage, and pilot inner and outer swirlers. Similarly, the mains airblast fuel injector has an annular mains fuel passage, and mains inner and outer swirlers.

Figure 6:
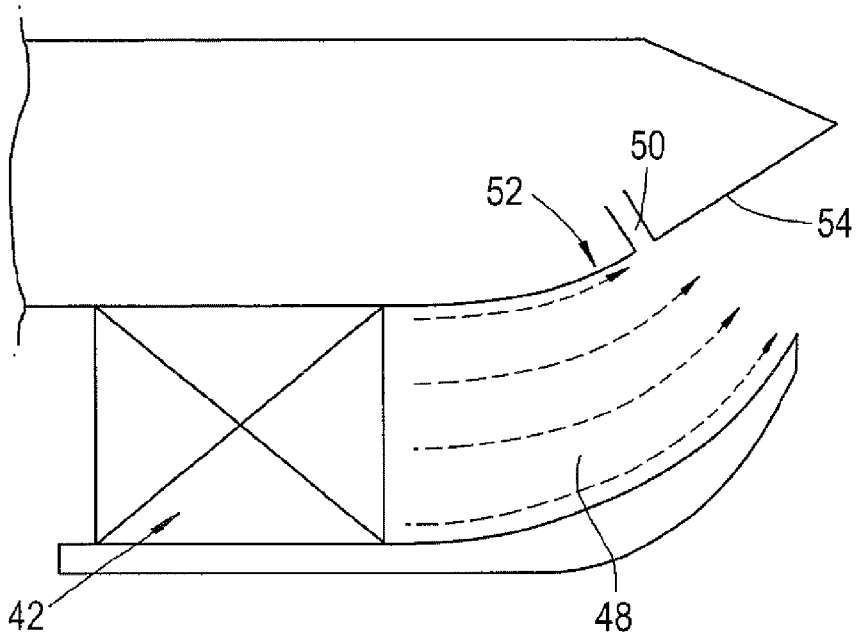
FIG. 6 shows a close up view of a mains inner swirler, its corresponding air passage, and an outlet port of the mains fuel passage of a mains airblast fuel injector of a fuel spray nozzle.

FIG. 6 shows a close up view of the mains inner swirler 42, its corresponding air passage 48, and an outlet port 50 of the mains fuel passage of the mains airblast fuel injector of the fuel spray nozzle 32.

The swirler 42 is located in a cylindrical section of the air passage 48. In a following section, the air passage diverges (i.e. turns radially outwards). In the longitudinal cross sectional view of FIG. 6, the transition between the cylindrical and divergent sections appears as a bend 52 in the passage. The outlet port 50 takes the form of an annular slot in the outer side wall of the air passage downstream of the bend. Fuel fed through the outlet port develops into a film on a frustoconical prefilmer surface 54 of the outer side wall. The swirling air flow (indicated by dotted arrowed lines) exiting the swirler travels along the air passage. In the divergent section, the flow area of the air passage decreases, accelerating the air flow and helping it to atomize the liquid fuel film into small droplets.

Significantly, the bend 52 is formed by smoothly curved portions of the side walls of the air passage. For example, as shown, the smoothly curved portion of the outer side wall extends over the entire axial distance between the swirler and the outlet port. This arrangement helps to reduce losses in the air flow, and in particular can reduce flow separation and the thickness of the boundary layer at the outer side wall. The atomization efficiency of the injector can thus be improved.

In addition, the vanes of the swirler 42 are configured to introduce a radially outward component to the air flow exiting the swirler which guides the air flow around the bend 52, further reducing losses, increasing the air flow velocity at the outer side wall, and improving atomization efficiency and mixing with the air flow before the flame-front. Specifically, the vane configuration increases the air velocity on the passage outer side wall upstream of the outlet port 50, increasing the shear forces between the air flow and fuel emanating from the port. The swirler configuration can be adjusted to match the amount of the radially outward component to the geometry of the bend.

Figure 7:
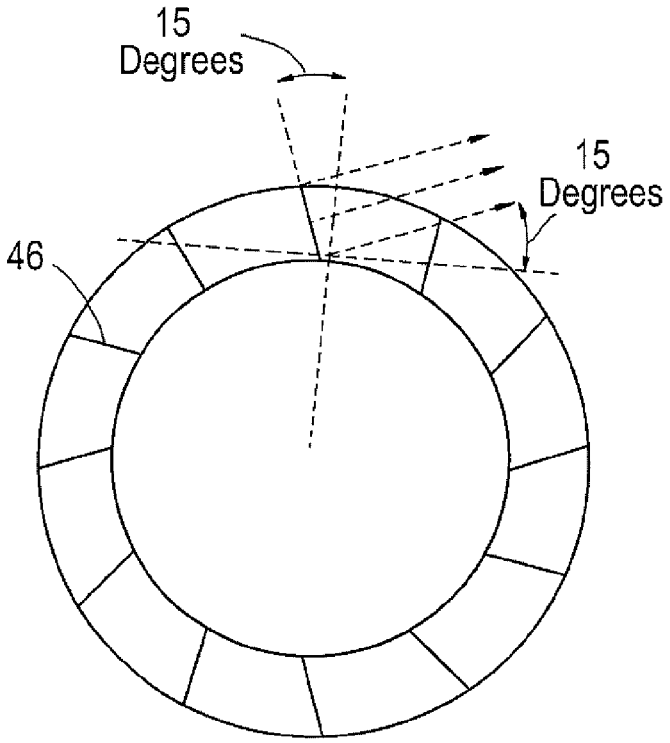
FIG. 7 shows schematically the trailing edges of a row of vanes of the mains inner swirler of FIG. 6 as viewed looking upstream along the air passage.

FIG. 7 shows schematically the trailing edges of the circumferential row of vanes 46 of the swirler 42, as viewed looking upstream along the air passage 48. For the vane at the top centre, the suction surface is on the left and the pressure surface on the right, producing a clockwise swirl direction. The vanes are leant so that, with increasing radial distance, across each inter-vane passage between neighbouring vanes the suction surface is inclined towards the pressure surface. The lean can be produced by inclining the leading and trailing edges of the vanes from the radial direction. The angle of inclination may be 10° or more, with an inclination of 15° illustrated in FIG. 7. The effect of the lean is to induce the radially outward component in the air flow, as shown by the tilted dashed arrowed lines extending from the top centre vane and indicating the direction of air flow from the swirler.

As drawn in FIG. 7 the lean is constant across the passage, but in variant configurations the lean may change, e.g. increase, with increasing radial distance across the passage.

The vanes 46 can be twisted to produce constant swirl from the inner side wall to the outer sidewall of the air passage 48.

In a variation configuration, only one of the leading and trailing edges of the vanes 46 may be leant. Typically it is the trailing edge. This configuration can produce a highly twisted vane in which the chordal lines of the aerofoil sections of the vanes are at different stagger angles.

Figure 8:
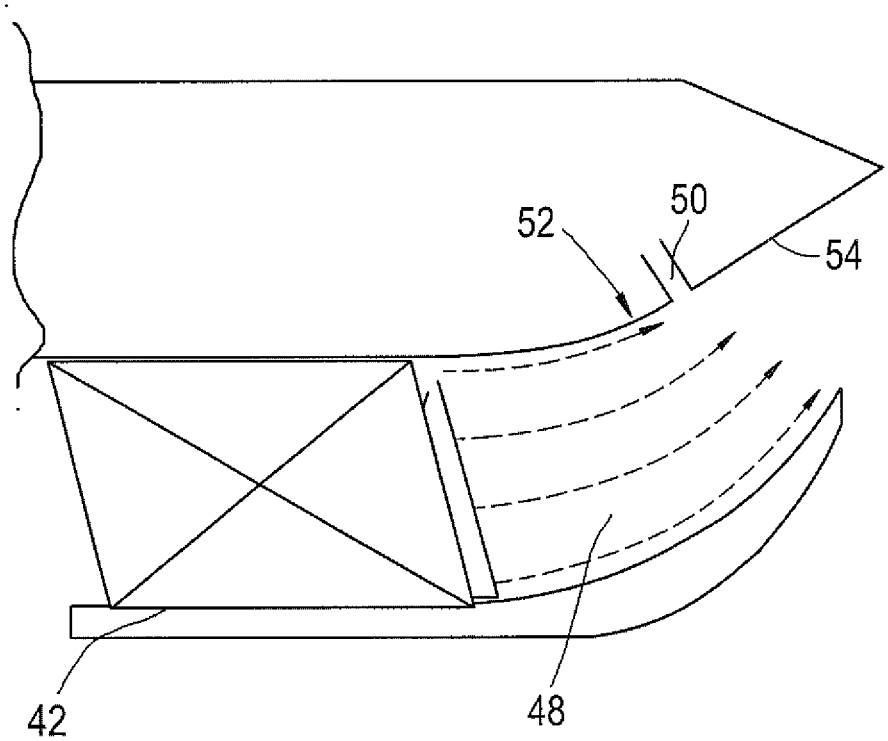
FIG. 8 shows a close up view of a variant mains inner swirler, its corresponding air passage, and an outlet port of the mains fuel passage of a mains airblast fuel injector of a fuel spray nozzle.

In addition, or as an alternative to leaning the vanes 46, the leading and/or trailing edges of the vanes may be forward swept to introduce the radial component to the air flow exiting the swirler 42. FIG. 8 shows a close up view of such a variant applied to the swirler of FIG. 6 in which both the leading and trailing edges are forward swept.

The improvements to the airblast fuel injector can increase combustion efficiency and reduce NOx emission by reducing variation in Fuel to Air Ratio (FAR) at the flame-front. Higher than average FAR regions increase the overall NOx and lower than average FAR regions reduce the overall combustion efficiency. Alternatively, by increasing the local velocity adjacent to the fuel outlet port, the overall pressure drop across the fuel spray nozzle can be reduced, providing an improvement in engine specific fuel consumption.

While the invention has been described in conjunction with the exemplary embodiments described above, many equivalent modifications and variations will be apparent to those skilled in the art when given this disclosure. For example, the vanes of the swirlers of the outer mains and outer pilot air passages can be configured to introduce an inward radial component to their air flows. Also the bends in these air passages can be formed from smoothly curved portions of the side walls. Accordingly, the exemplary embodiments of the invention set forth above are considered to be illustrative and not limiting. Various changes to the described embodiments may be made without departing from the spirit and scope of the invention.

The invention claimed is:

1. An airblast fuel injector for a fuel spray nozzle of a gas turbine engine, the fuel injector having an annular air passage for the passage of a swirling air flow therethrough, the swirling air flow being used by the fuel injector to produce an atomised fuel spray, wherein:

the air annular passage contains a swirler for producing the swirling air flow, the swirler comprising a circumferential row of vanes which span inner and outer side walls of the annular air passage;

viewed on a longitudinal section through the fuel injector, the annular air passage has a bend downstream of the swirler, the bend changing the direction of the annular air passage; and the vanes are configured to introduce a radial outward component to the air flow exiting the swirler, the radial outward component guiding the air flow around the bend, wherein the vanes are leant to introduce the radial component to the air flow exiting the swirler such that, across each inter-vane passage formed by a suction surface of one vane and a facing pressure surface of a neighbouring vane, with increasing radial distance the lean inclines the suction surface towards the pressure surface.

2. The airblast fuel injector of claim 1, wherein the bend changes the direction of the annular air passage such that the annular air passage turns radially outwards downstream of the bend, the vanes being configured to introduce a radial outward component to the air flow exiting the swirler.

3. The airblast fuel injector of claim 1, which further has an annular fuel passage coaxial with the annular air passage, the annular fuel passage feeding fuel into the annular air passage through a port located downstream of the bend at the radially outer side wall of the annular air passage.

4. The airblast fuel injector of claim 3, wherein the bend is formed by smoothly curved portions of the side walls of the annular air passage.

5. The airblast fuel injector of claim 4, wherein the smoothly curved portions of the side walls begin at the swirler.

6. The airblast fuel injector of claim 1, wherein the leading and/or trailing edges of the vanes are forward swept to introduce the radial outward component to the air flow exiting the swirler.

7. A fuel spray nozzle of a gas turbine engine having the airblast fuel injector of claim 1.

8. A fuel spray nozzle according to claim 1, wherein the airblast fuel injector is a mains fuel injector, the nozzle further having a pilot fuel injector radially inwardly of the mains fuel injector.

9. A combustor of a gas turbine engine having a plurality of fuel spray nozzles according to claim 7.

10. A gas turbine engine having the combustor of claim 9.

11. An airblast fuel injector for a fuel spray nozzle of a gas turbine engine, the fuel injector having an annular air passage for the passage of a swirling air flow therethrough, the swirling air flow being used by the fuel injector to produce an atomised fuel spray, wherein the annular air passage contains a swirler for producing the swirling air flow, the swirler comprising a circumferential row of vanes which span inner and outer side walls of the annular air passage, viewed on a longitudinal section through the fuel injector, the annular air passage has a bend downstream of the swirler, the bend changing the direction of the annular air passage such that the annular air passage turns radially outwards downstream of the bend, each vane comprises a suction surface and a pressure surface, the vanes are configured to introduce a radial outward component to the air flow exiting the swirler, the radial outward component guiding the air flow around the bend, the vanes are leant to introduce the radial outward component to the air flow exiting the swirler such that, across each inter-vane passage formed by a suction surface of one vane and a facing pressure surface of a neighbouring vane, with increasing radial distance the lean inclines the suction surface towards the pressure surface, and an annular fuel passage coaxial with the annular air passage, the annular fuel passage feeding fuel into the annular air passage through a port located downstream of the bend at the radially outer side wall of the annular air passage.

12. An airblast fuel injector for a fuel spray nozzle of a gas turbine engine, the fuel injector having an annular air passage for the passage of a swirling air flow therethrough, the swirling air flow being used by the fuel injector to produce an atomised fuel spray, wherein the annular air passage contains a swirler for producing the swirling air flow, the swirler comprising a circumferential row of vanes which span inner and outer side walls of the annular air passage, viewed on a longitudinal section through the fuel injector, the annular air passage has a bend downstream of the swirler, the bend changing the direction of the annular air passage such that the annular air passage turns radially outwards downstream of the bend, each vane comprises a suction surface and a pressure surface, the vanes are configured to introduce a radial outward component to the air flow exiting the swirler, the radial outward component guiding the air flow around the bend, the each vane comprises a leading edge and a trailing edge, the leading and/or trailing edges of the vanes are forward swept to introduce the radial outward component to the air flow exiting the swirler, and an annular fuel passage coaxial with the annular air passage, the annular fuel passage feeding fuel into the annular air passage through a port located downstream of the bend at the radially outer side wall of the annular air passage, wherein the bend is formed by smoothly curved portions of the inner and outer side walls of the annular air passage.

* * * * *